US008484882B2

(12) United States Patent
Haley et al.

(10) Patent No.: US 8,484,882 B2
(45) Date of Patent: Jul. 16, 2013

(54) FORWARD MOUNTED GUN SIGHT WITH ILLUMINATION APPARATUS

(75) Inventors: Travis D. Haley, Montrose, CO (US); Eric C. Burt, Broomfield, CO (US); Richard M. Fitzpatrick, Longmont, CO (US); Michael T. Mayberry, Denver, CO (US)

(73) Assignee: Magpul Industries Corp., Erie, CO (US)

( * ) Notice: Subject to any disclaimer, the term of this patent is extended or adjusted under 35 U.S.C. 154(b) by 0 days.

(21) Appl. No.: 12/968,072

(22) Filed: Dec. 14, 2010
(Under 37 CFR 1.47)

(65) Prior Publication Data

US 2012/0180368 A1 Jul. 19, 2012

Related U.S. Application Data

(60) Provisional application No. 61/286,365, filed on Dec. 14, 2009.

(51) Int. Cl.
*F41G 1/00* (2006.01)

(52) U.S. Cl.
USPC ..... 42/132; 42/111; 42/124; 42/114; 42/146

(58) Field of Classification Search
USPC ..... 42/132, 114, 115, 124, 146, 111, 42/117
See application file for complete search history.

(56) References Cited

U.S. PATENT DOCUMENTS 5,784,823 A * 7/1998 Chen ..... 42/115
6,671,991 B1 * 1/2004 Danielson ..... 42/114
6,931,778 B1 * 8/2005 Nelson et al. ..... 42/120
7,331,137 B2 * 2/2008 Hsu ..... 42/114
7,726,229 B2 * 6/2010 Schwerman et al. ..... 89/41.17
7,814,699 B2 * 10/2010 Storch et al. ..... 42/137
7,908,782 B1 * 3/2011 LaRue ..... 42/128
7,908,784 B2 * 3/2011 Kim ..... 42/146
7,913,439 B2 * 3/2011 Whaley ..... 42/90
7,954,273 B1 * 6/2011 Swan ..... 42/115
8,006,428 B2 * 8/2011 Moore et al. ..... 42/117
8,015,744 B1 * 9/2011 Swan ..... 42/147
8,156,679 B1 * 4/2012 Swan ..... 42/124
8,230,636 B1 * 7/2012 Swan ..... 42/124
2007/0240355 A1 * 10/2007 Hsu ..... 42/115
2007/0271834 A1 * 11/2007 Keng ..... 42/124
2008/0276520 A1 * 11/2008 Ballard ..... 42/143
2009/0049734 A1 * 2/2009 Storch et al. ..... 42/136
2010/0122485 A1 * 5/2010 Kincel ..... 42/146
2011/0173871 A1 * 7/2011 Moore et al. ..... 42/114
2011/0225867 A1 * 9/2011 Moore et al. ..... 42/114
2012/0036756 A1 * 2/2012 Brown ..... 42/71.01
2012/0055063 A1 * 3/2012 Lindau et al. ..... 42/113
2012/0102809 A1 * 5/2012 Moore et al. ..... 42/114
2012/0131840 A1 * 5/2012 Toole ..... 42/114
2012/0159832 A1 * 6/2012 Moore et al. ..... 42/114
2012/0180368 A1 * 7/2012 Haley et al. ..... 42/132
2012/0180370 A1 * 7/2012 McKinley ..... 42/146

* cited by examiner

*Primary Examiner* — Michelle Clement

(74) *Attorney, Agent, or Firm* — Geoffrey E. Dobbin; Dobbin IP Law P.C.

(57) ABSTRACT

The present invention is a rail mounted back-up sight with at least one, but preferred two, illumination apparatuses mounted thereon. The back-up sight features a sight housing that is configured to selectively alternate between a stowed and a spring-biased deployed position. Any type of illumination apparatus may be used, but the preferred apparatus is a flashlight, mounted upon wither side of a sight base. Either a front or a rear sight may be utilized as could different types of illumination apparatuses.

10 Claims, 6 Drawing Sheets

FORWARD MOUNTED GUN SIGHT WITH ILLUMINATION APPARATUS

CROSS-REFERENCES TO RELATED APPLICATIONS

This Application claims priority as a non-provisional perfection of prior provisional application No. 61/286,365, filed Dec. 14, 2009, and incorporates the same by reference herein.

FIELD OF THE INVENTION

The present invention relates to the field of firearms and more particularly relates to a forward back-up sight with an illumination apparatus mounted thereon.

BACKGROUND OF THE INVENTION

The firearm is the weapon of choice in most modern militaries. It is a tool used in many different battle and practice scenarios, including low-light situations. However, in order to effectively use a firearm, one must be able to see a target. To this end, many methods and systems have been developed to mount a light or a targeting device on a firearm in a manner to keep the users hands otherwise free to operate the weapon. These solutions have endeavored to position the light in a manner to illuminate what is in front of the shooter, but must avoid the line of sight. They must also be lightweight and easily operated, adding little encumbrance to the weapon or its use. Most such devices mount off of the side of the weapon, towards the front of the weapon. This position, however block some of the user's field of vision. They also will favor one side over another. Since an added device will necessarily block some of the field of vision, it is preferred to lessen the blocking profile as much as possible. It is also preferred to center the light as much as possible.

The present invention is a back-up sight that incorporates an illumination apparatus in a manner that is unobtrusive to the line of sight and poses little excess weight. The weight is also evenly distributed on the weapon so as to minimize encumbrance.

The present invention represents a departure from the prior art in that the back-up sight of the present invention allows for a common feature of the weapon to be enhanced for a dual purpose. This then lessens parts and other accessories mounted upon the weapon, reducing blocked field of vision, while utilizing standard operating procedures with minimal amendment. Since the device is centrally balanced on the weapon, light and weight are not favored from one side to the other.

SUMMARY OF THE INVENTION

In view of the foregoing disadvantages inherent in the known types of illumination devices, this invention provides a combined back-up sight and illumination apparatus. As such, the present invention's general purpose is to provide a new and improved back-up sight that doubles as a mounting platform for a forward mounted illumination apparatus that is relatively easy to use, requires little change in standard operating procedures, has a minimal effect on the encumbrance of the weapon and is effective in light placement.

To accomplish these objectives, the back-up sight comprises a base and sight housing, hingedly attached with the sight housing spring biased into an upward position while a latch holds it down in a stowed position. At least one illumination apparatus is mounted upon a side of the base, with a second ideally mounted upon an opposite side. While the specification and figures do depict the combined apparatus as a front sight, it should be recognized that a rear sight would also be within the purview of the invention, as would the utilization of different types of lights.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

With reference now to the drawings, the preferred embodiment of the front back-up sight is herein described. It should be noted that the articles "a", "an", and "the", as used in this specification, include plural referents unless the content clearly dictates otherwise.

Figure 3:
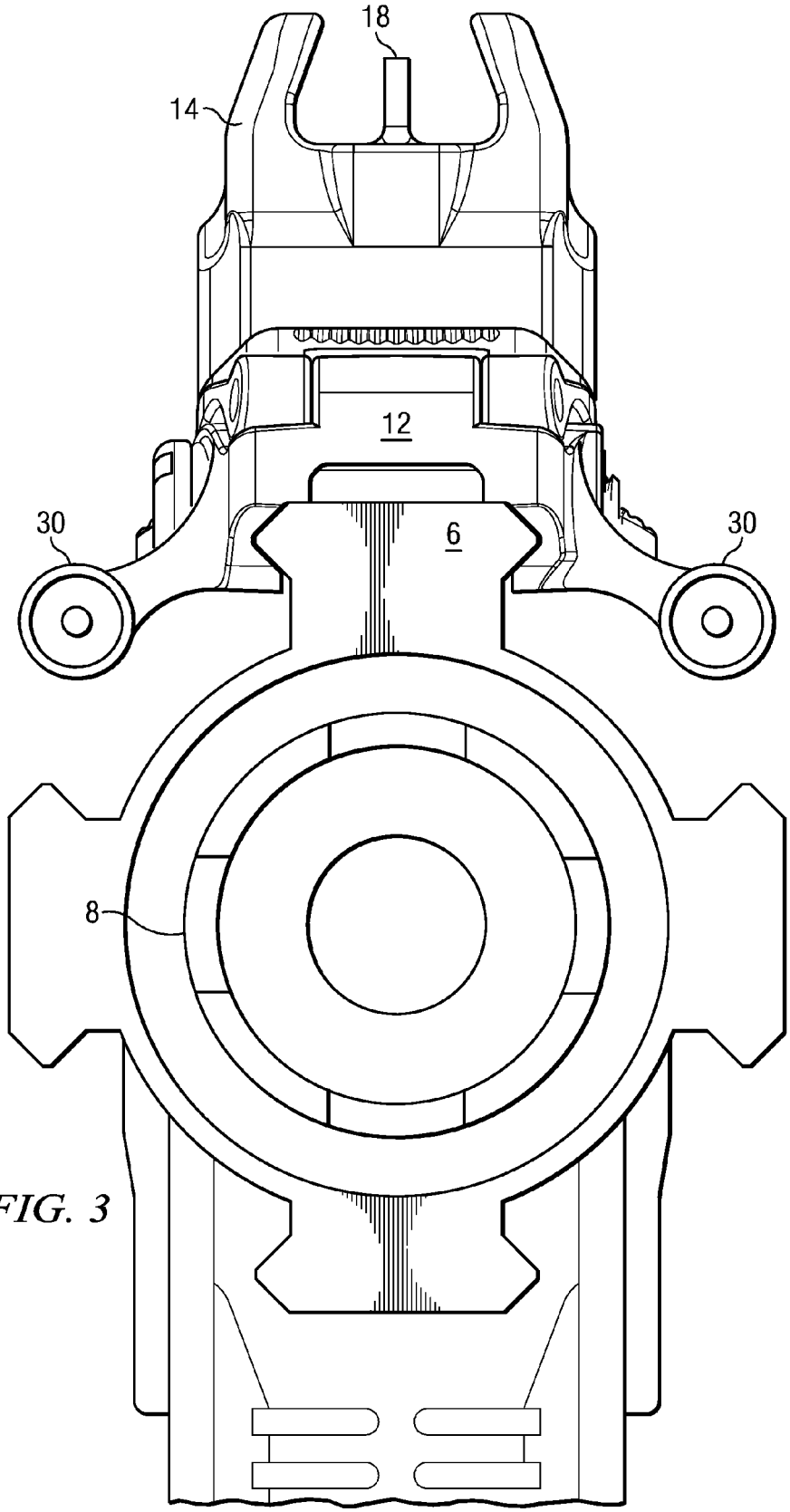
FIG. 3 is a front elevation of the back-up sight of FIG. 1, mounted on a rifle.
Figure 4:
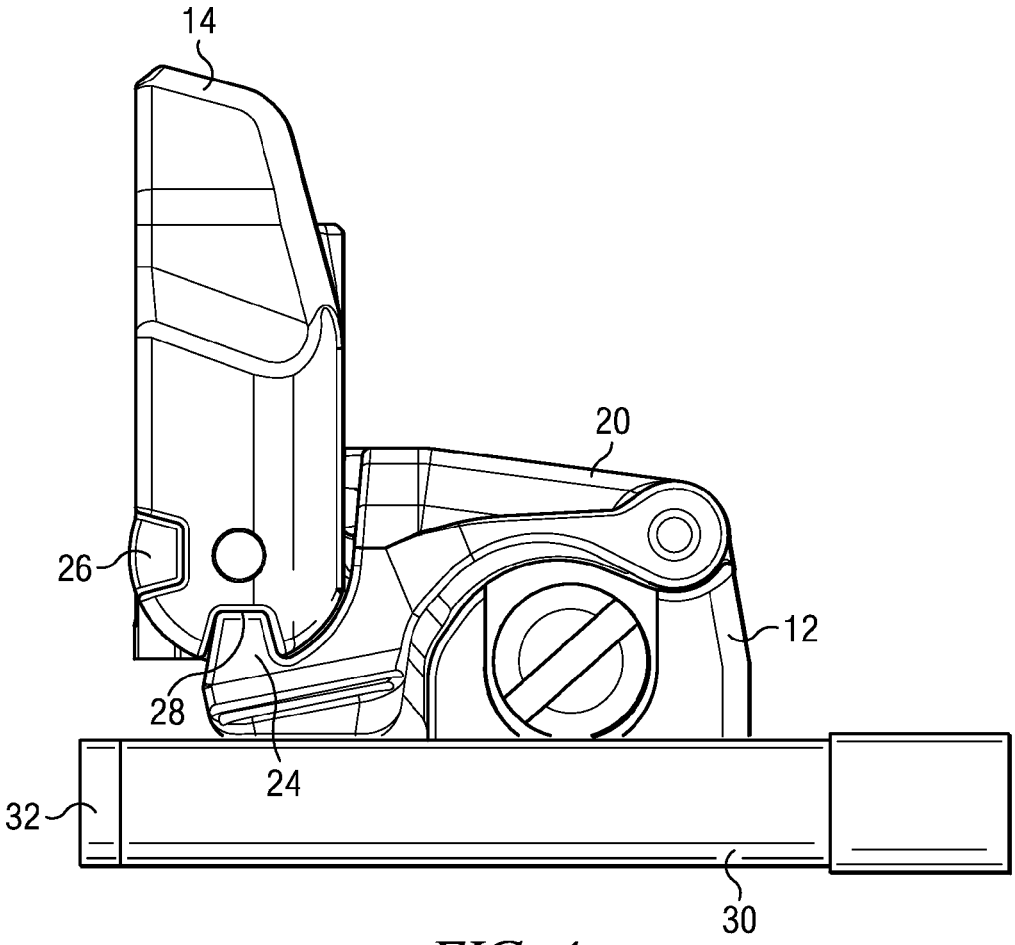
FIG. 4 is a side elevation of the back-up sight of FIG. 1.
Figure 5:
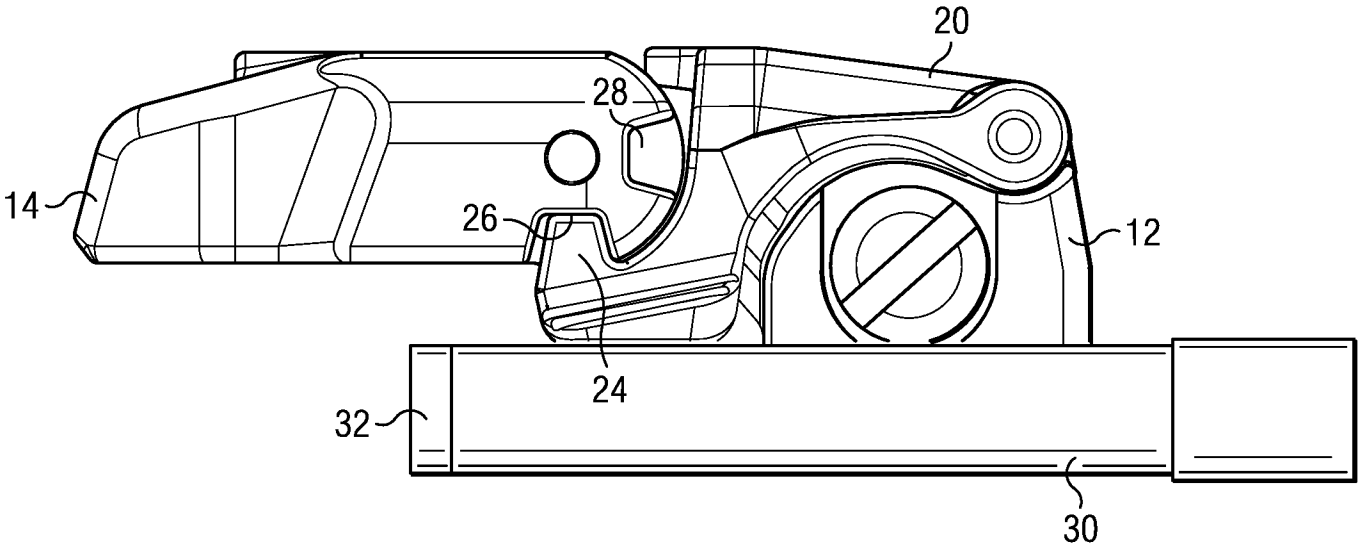
FIG. 5 is a side elevation of the back-up sight of FIG. 4, in a stowed configuration.
Figure 6:
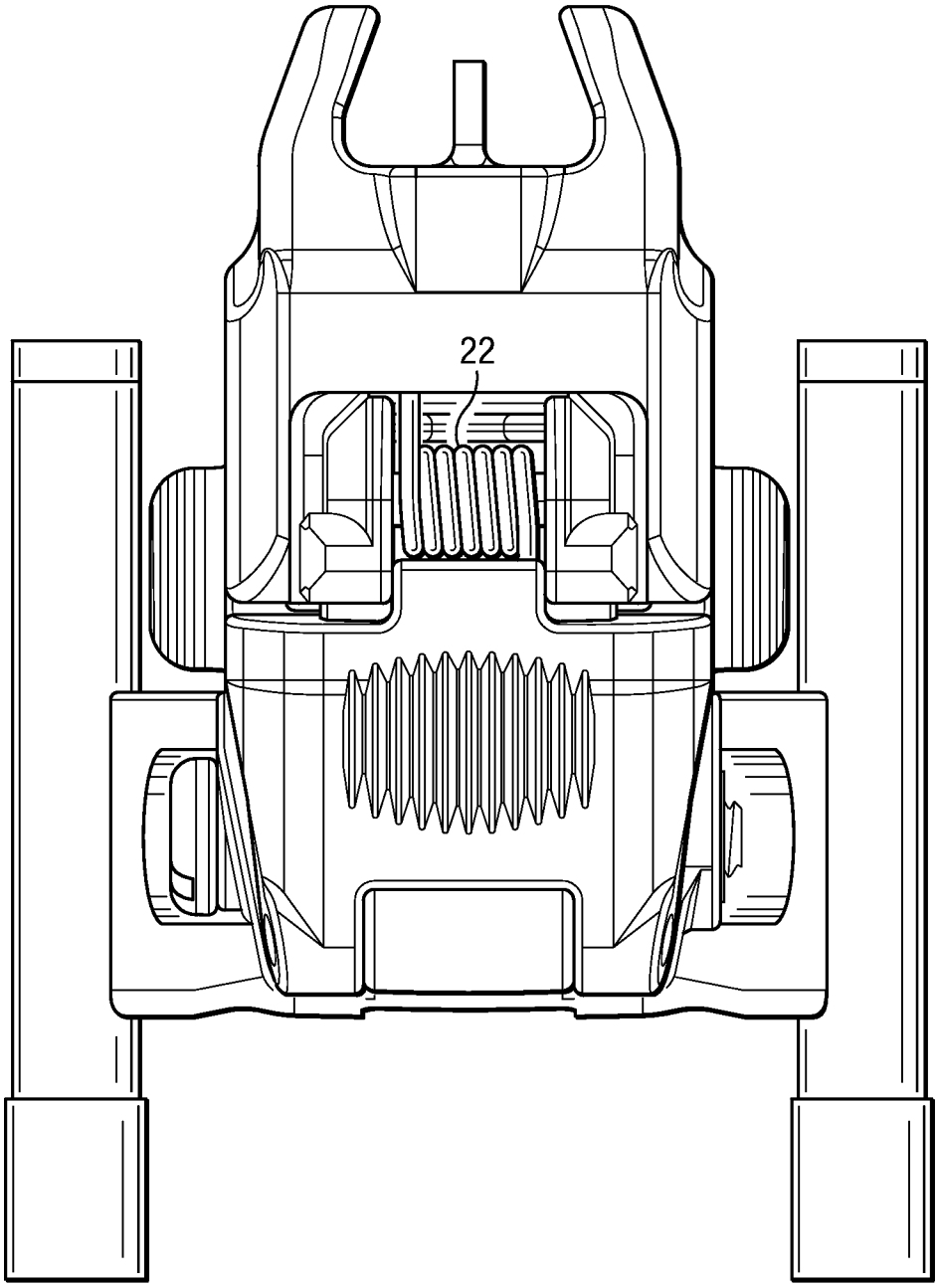
FIG. 6 is a top plan view of the back-up sight of FIG. 5.

With reference to FIGS. 3-6, the back-up sight 10 comprises a base 12 and sight housing 14 hingedly connected together. The sight housing is spring-biased 22 (FIG. 6) in the deployed position, as shown in FIG. 4. A latch 20 is also hingedly attached to the base 12. In the depicted embodiment, the latch 20 forms a carapace over base 12 and is hinged at an edge of the base 12 opposite the sight housing 14. Latch 20 features two teeth 24, on opposite sides, and each tooth 24 selectively engages one of a set of two notches 26, 28, each set likewise being on opposite sides of the sight housing 14. While stowed, FIG. 5, latch 20 engages notches 26 and secures the sight housing 14 against the spring bias 22. Upon release, the spring bias 22 flips the sight housing 14 into a deployed position which is generally perpendicular to the body 12 and the latch 20 engages notches 28, FIG. 4.

Figure 2:
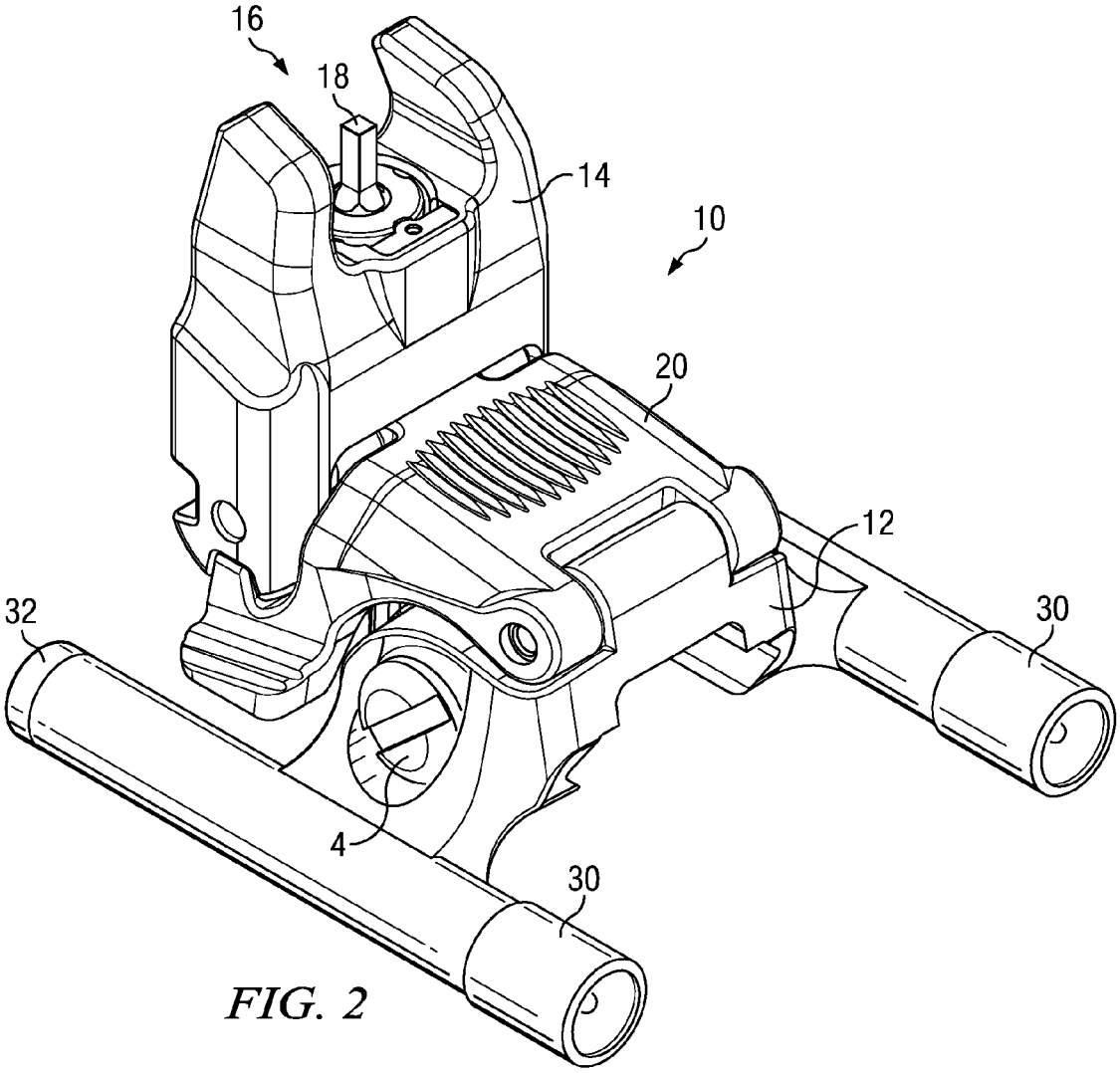
FIG. 2 is another upper perspective view of the front back-up sight of FIG. 1.

Referring to FIGS. 2 and 3, two illumination apparatuses 30 are on opposite sides of the base, generally perpendicular to the hinges of the latch 20 and sight housing 14 and pointing forwards. Those shown are tubular flashlights with a rear switch 32. They are shown to be of one piece with, but may be detachable from, the body. It is readily conceivable that any type of illumination apparatus or system may be configured to work with the invention, including a remote switching system allowing for both joint and separate operation. Different light types including incandescent, halogen, LED, laser and other illumination apparatus, and other variances known and later discovered in the art may be used. It is also conceivable that different types of illumination apparatuses may simultaneously be used (i.e. an incandescent light and a laser pointer).

Figure 1:
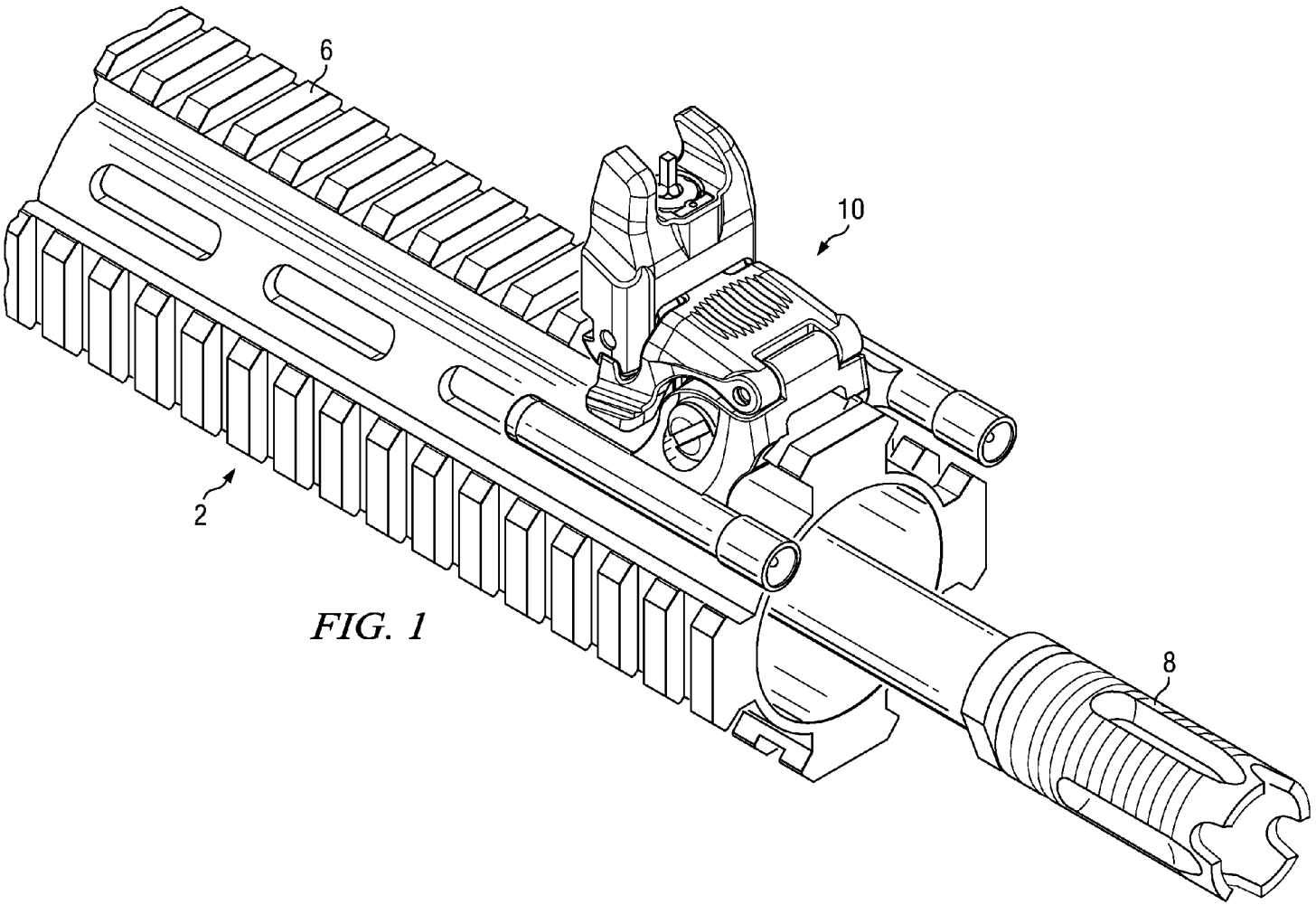
FIG. 1 is an upper perspective view of a front back-up sight embodying the present invention, mounted upon a rifle.

It should be noted in FIGS. 1 and 3 that the back-up sight 10 is mounted in a forward position over the barrel 8 of the weapon 2. The depicted means for attaching the sight 10 to a firearm 2 is a conventional rail system, using a weaver or Picatinny-style rail 6, a rail interface in the base and a securing bolt 4 (FIG. 2). Other means known or later developed may be used without departing from the purview of this specification. It is important that the illumination apparatuses 30 be positioned on the body 12 in such a manner that they do not interfere with the means for attaching the sight to the firearm 2 or the operation of the latch 20. To this end, as shown in the figures, but more particularly FIG. 2, the illumination apparatuses 30 are positioned well below the securing bolt 4 and the latch. This positioning is, however, a simple matter of design geometry and the positioning of the illumination apparatuses 30, the means for attachment, and the latch 20 in different relative positions is well within the purview of this invention. In the depicted embodiment, the sight 10 is then balanced over the barrel and provides no net torque on the weapon along the barrel axis. It also directs the light specifically at where the barrel points, regardless of how the weapon is moved. Being small and of lightweight construction (ideally utilizing polymer and/or light metals such as aluminum), very little weight is added and the compact design does not interfere with the line of sight of the user. As shown in FIG. 2, the sight housing 14 features a sight element 18 within a sight window 16. The depicted sight is a front sight, as may be denoted by sighting element 18 being a bead or post in the sight window; however, a rear sight, where the sighting element 18 is a block having an aperture or notch, could also be used. The forward sight is preferred, however, due to its location near the tip of the barrel 8 because it will then track the line of fire better than a more rearward mounting location.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. A back-up sight for a firearm comprising:

a. a base mountable upon a firearm rail, said base having a top surface, a front side, a rear side, two opposing lateral sides a bottom, and a bolt located in a bore extending between the lateral sides of the base, configured for mounting upon said rail;

b. a sight housing hingedly mounted upon the base and spring biased in an upward position, generally perpendicular to the base, said sight housing defining a sight window;

c. a latch for securing the sight housing in a position generally in-line with the base, against the spring bias, releasable such that when the latch is released the spring bias will move the sight housing into the upward position; and d. an illumination apparatus positioned upon one of the opposing lateral sides beneath a level of the bolt.

2. The back-up sight of claim 1, further comprising a second illumination apparatus mounted upon the other of the two opposing lateral sides directly across the first illumination apparatus.

3. The back-up sight of claim 2, the illumination apparatuses being selected from the set of illumination apparatuses consisting of: halogen lights, LED lights, incandescent lights, and laser lights.

4. The back-up sight of claim 3, the illumination apparatuses each comprising a cylindrical housing, lens and a switch, the housing being positioned along the lateral sides of the base.

5. The back-up sight of claim 2, the illumination apparatuses each comprising a cylindrical housing, lens and a switch, the housings being positioned along the lateral sides of the base.

6. The back-up sight of claim 1, the illumination apparatus being selected from the set of illumination apparatuses consisting of: halogen lights, LED lights, incandescent lights, and laser lights.

7. The back-up sight of claim 6, the illumination apparatus comprising a cylindrical housing, lens and a switch, the housing being positioned along the side of the base.

8. The back-up sight of claim 1, the illumination apparatus comprising a cylindrical housing, lens and a switch, the housing being positioned along the side of the base.

9. The back-up sight of claim 1, the back-up sight comprising a sighting bead located within the sight window.

10. The back-up sight of claim 1, the back-up sight comprising a sighting block located within the sight window.

* * * * *